US008544414B1

(12) United States Patent
Gross et al.

(10) Patent No.: US 8,544,414 B1
(45) Date of Patent: Oct. 1, 2013

(54) METHOD AND SYSTEM FOR ANIMAL WASTE COLLECTION

(76) Inventors: Robert Ray Gross, Brainerd, MN (US); Nita Royston Gross, Brainerd, MN (US)

( * ) Notice: Subject to any disclaimer, the term of this patent is extended or adjusted under 35 U.S.C. 154(b) by 311 days.

(21) Appl. No.: 12/904,000

(22) Filed: Oct. 13, 2010

Related U.S. Application Data

(60) Provisional application No. 61/279,851, filed on Oct. 27, 2009.

(51) Int. Cl.
*A01K 29/00* (2006.01)

(52) U.S. Cl.
USPC ..... 119/170; 119/168

(58) Field of Classification Search
USPC ..... 119/161, 168, 170; 15/257.1, 257.9; D34/1
See application file for complete search history.

(56) References Cited

U.S. PATENT DOCUMENTS

| | | | | |
|---|---|---|---|---|
| 3,685,088 | A | 8/1972 | Doherty | 15/257.6 |
| 4,017,015 | A | 4/1977 | Jefferson | 229/19 |
| 4,156,400 | A | 5/1979 | Migdal | 119/1 |
| 4,205,869 | A | 6/1980 | Mathis | 294/1 |
| 4,865,371 | A | 9/1989 | Egberg | 294/1.3 |
| 4,958,871 | A * | 9/1990 | Hemans | 294/1.4 |
| 5,134,974 | A * | 8/1992 | Houser | 119/168 |
| 5,564,762 | A | 10/1996 | Ring | 294/1.3 |
| 6,116,194 | A | 9/2000 | Komarnitskiy | 119/867 |
| 6,123,046 | A | 9/2000 | Gemeniano | 119/161 |
| 6,158,395 | A | 12/2000 | Bauklon | 119/867 |
| 6,305,322 | B1 | 10/2001 | Patel | 119/161 |
| 6,505,578 | B1 | 1/2003 | Scott et al. | 119/867 |
| 6,871,891 | B2 | 3/2005 | Rivera Garcia | 294/1.3 |
| 6,941,896 | B1 | 9/2005 | Morin | 119/867 |
| 6,964,247 | B1 | 11/2005 | Lin | 119/867 |
| 7,506,615 | B1 | 3/2009 | Sansone et al. | 119/867 |
| 2008/0276883 | A1 | 11/2008 | Perez Tomas | |

FOREIGN PATENT DOCUMENTS

| | | | |
|---|---|---|---|
| JP | 09187184 A | * | 7/1997 |
| JP | 11089472 A | * | 4/1999 |
| JP | 2001061365 A | * | 3/2001 |
| JP | 2001178294 A | * | 7/2001 |
| JP | 2005245416 A | * | 9/2005 |
| JP | 2006067882 A | * | 3/2006 |

OTHER PUBLICATIONS

Machine translation of JP11089472 to Motomura, published Apr. 1999.*

* cited by examiner

*Primary Examiner* — Son T Nguyen
*Assistant Examiner* — Kathleen Alker
(74) *Attorney, Agent, or Firm* — Hayes Soloway P.C.

(57) ABSTRACT

A compact animal waste collector and method thereof is provided. The collector includes a planar base having a first side and a second side. A plurality of walls is affixed perpendicularly to the base. A substantially planar first cover is hinged to at least one of the plurality of walls, the first cover forming an interior compartment proximate to the first side of the base and movable between at least a first position and a second position. A bag is removably located within the collector and lining the interior compartment, the bag having an opening edge inverted about an exterior of the collector. A storage compartment is formed on the second side of the base and enclosable by the plurality of walls and a substantially planar second cover hinged to at least one of the plurality of walls. The storage compartment may house a replacement bag.

19 Claims, 6 Drawing Sheets

METHOD AND SYSTEM FOR ANIMAL WASTE COLLECTION

CROSS REFERENCE TO RELATED APPLICATION

This application claims benefit of U.S. Provisional Application Ser. No. 61/279,851 filed Oct. 27, 2009, the entire disclosure of which is incorporated herein by reference.

FIELD OF THE DISCLOSURE

The present disclosure is generally related to waste collection and more particularly is related to a method and system for animal waste collection.

BACKGROUND OF THE DISCLOSURE

In many communities throughout the world, it is unlawful to allow an animal to mess or pass waste on public property or another's private property and not clean it up after. Animal waste, primarily fecal matter from dogs, is unsanitary and is considered a nuisance when it is not cleaned up after. However, an animal owner who must clean up after their pet faces the unpleasant task of removing the waste and disposing of it. Often, this is required in remote locations, such as in a park or on a neighbor's yard and proper disposal isn't immediately available. The owner is forced to use a waste container, usually consisting of a plastic bag, to collect the waste and store it until proper disposal is available.

Handling the waste of an animal is often considered a very unpleasant task because it includes many unpleasant aspects, such as seeing the waste, feeling the waste through the container and smelling an odor from the waste. The texture of the waste after being passed by an animal is often squishy and conforms to the container that it is being picked up in. Thus, it is undesirable for an owner to use a flexible plastic bag to clean up the waste, because the owner will be able to feel the squishy texture of the waste through the bag. Once the waste is collected, the animal's owner may still be subject to the odor of the waste for the remainder of the excursion, or the visual sight of the waste through the bag. These unpleasant aspects of cleaning up animal waste often result in owners neglecting to clean up the waste, or the waste being improperly disposed of.

Thus, a heretofore unaddressed need exists in the industry to address the aforementioned deficiencies and inadequacies.

SUMMARY OF THE DISCLOSURE

Embodiments of the present disclosure provide a system and method for a compact animal waste collector. Briefly described, in architecture, one embodiment of the system, among others, can be implemented as follows. The collector includes a substantially planar base having a first side and a second side. A plurality of walls is affixed to the base and positioned substantially perpendicular to the base. A substantially planar first cover is hinged to at least one of the plurality of walls, wherein the first cover forms an interior compartment proximate to the first side of the base and movable between at least a first position and a second position, wherein the first cover in the first position substantially encloses the interior compartment and the first cover in the second position forms at least one opening in the interior compartment. A bag is removably located at least partially within the collector and lines the interior compartment, wherein the bag has an opening edge inverted about at least a portion of an exterior of the collector thereby exposing an inside surface of the bag. The collector is sized to fully house a quantity of animal waste within the interior compartment. A storage compartment is formed on the second side of the base and is enclosable by the plurality of walls and a substantially planar second cover hinged to at least one of the plurality of walls, wherein the storage compartment is sized to house at least one replacement bag.

The present disclosure can also be viewed as providing methods of collecting and storing animal waste. In this regard, one embodiment of such a method, among others, can be broadly summarized by the following steps: A method of collecting and storing animal waste comprising: forming an interior compartment within a collector, the interior compartment having a substantially planar base having a first side and a second side, a plurality of walls, affixed to the base and positioned substantially perpendicular to the base, and a substantially planar first cover hinged to at least one of the plurality of walls, the first cover forming an interior compartment proximate to the first side of the base and movable between at least a first position and a second position, wherein the first cover in the first position substantially encloses the interior compartment and the first cover in the second position forms at least one opening in the interior compartment; forming a storage compartment on the second side of the base, wherein the storage compartment is enclosable by the plurality of walls and a substantially planar second cover hinged to at least one of the plurality of walls; housing at least one replacement bag within the storage compartment; positioning the first cover in the second position; lining an interior surface of the interior compartment with a bag removably located at least partially within the collector; inverting an opening edge of the bag about an exterior of the collector, thereby exposing an inside surface of the bag; positioning the collector with the exposed inside surface of the bag proximate to a quantity of animal waste; relocating the quantity of animal waste to within the interior compartment, wherein the bag prevents the quantity of animal waste from contacting the collector; and moving the first cover from the second position to the first position, thereby enclosing the quantity of animal waste within the interior compartment.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
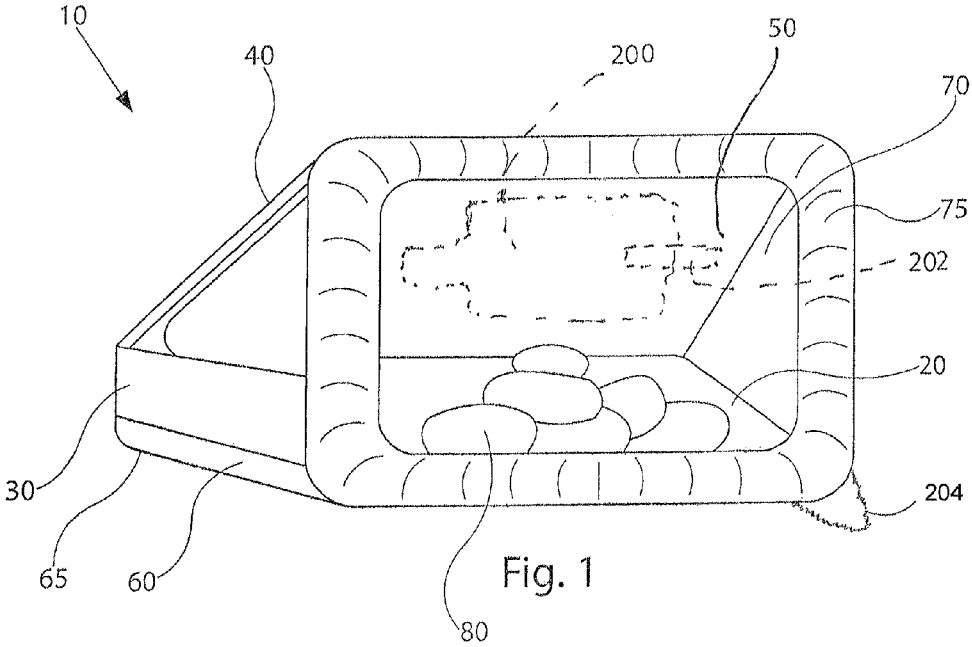
FIG. 1 is a plan view illustration of a compact animal waste collector, in accordance with a first exemplary embodiment of the present disclosure.
Figure 2:
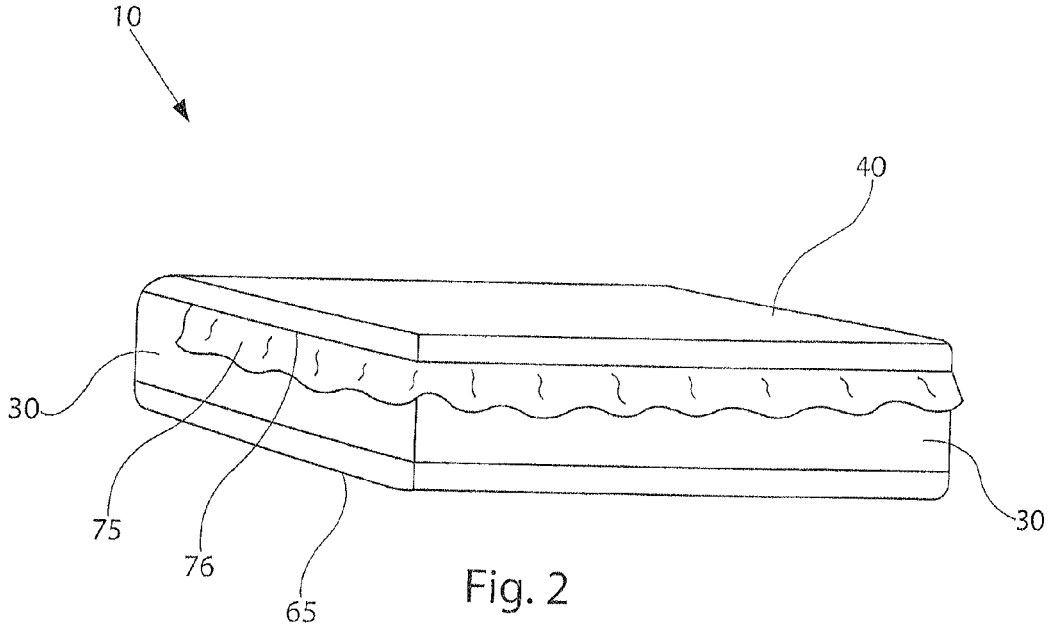
FIG. 2 is a plan view illustration of a compact animal waste collector in a closed position, in accordance with the first exemplary embodiment of the present disclosure.

FIG. 1 is a plan view illustration of a compact animal waste collector 10, in accordance with a first exemplary embodiment of the present disclosure. The compact animal waste collector 10, or collector 10, includes a substantially planar base 20 having a first side and a second side. A plurality of walls 30 are affixed to the base 20 and are positioned substantially perpendicular to the base 20. A substantially planar first cover 40 is hinged to at least one of the plurality of walls 30. The first cover 40 forms an interior compartment 50 proximate to a first side of the base 20 and is movable between at least a first position and a second position. When the first cover 40 is in the first position, the first cover 40 is in substantially parallel opposition to the base 20, in which the interior compartment 50 is substantially enclosed (FIG. 2). When the first cover 40 is in the second position, it forms an interior compartment 50 that has at least one opening.

A bag 70 is removably located at least partially within the collector 10 and lining the interior compartment 50. The bag 70 has an opening edge 75 position to be inverted about an exterior of the collector 10 exposing an inside surface of the bag 70. The collector 10 is sized to fully house a quantity of animal waste 80 within the interior compartment 50. A storage compartment 60 is formed on the second side of the base 20 and is enclosable by the plurality of walls 30 and a substantially planar second cover 65, which is hinged to at least one of the plurality of walls 30. The storage compartment 60 is sized to house at least one replacement bag (FIG. 3).

The collector 10 may provide for a collection and storage of a quantity of animal waste 80, which may mitigate much of the unpleasant aspects of cleaning up after an animal. These unpleasant aspects include the sight, texture, odor and unsanitary characteristics of animal waste. The collector 10 is a tool that may remove some or all of this unpleasantness. The collector 10 may be used with any type of animal, but is preferably used with a domestic animal that creates waste in a location where it is customary or required to remove the animal waste. However, using the collector 10 with a non-domestic animal is also within the scope of this disclosure. In addition, the quantity of waste 80 may be excrement or fecal matter from any animal, but it may also include a vomited material, a regurgitated material, or any other substance that may be collected. For example, a dog may create waste within a public location where it is required by law for the dog's walker to remove the waste. The collector 10 may be easily carried in a dog walker's purse, pocket or bag, and then retrieved when the dog creates the waste.

Figure 3:
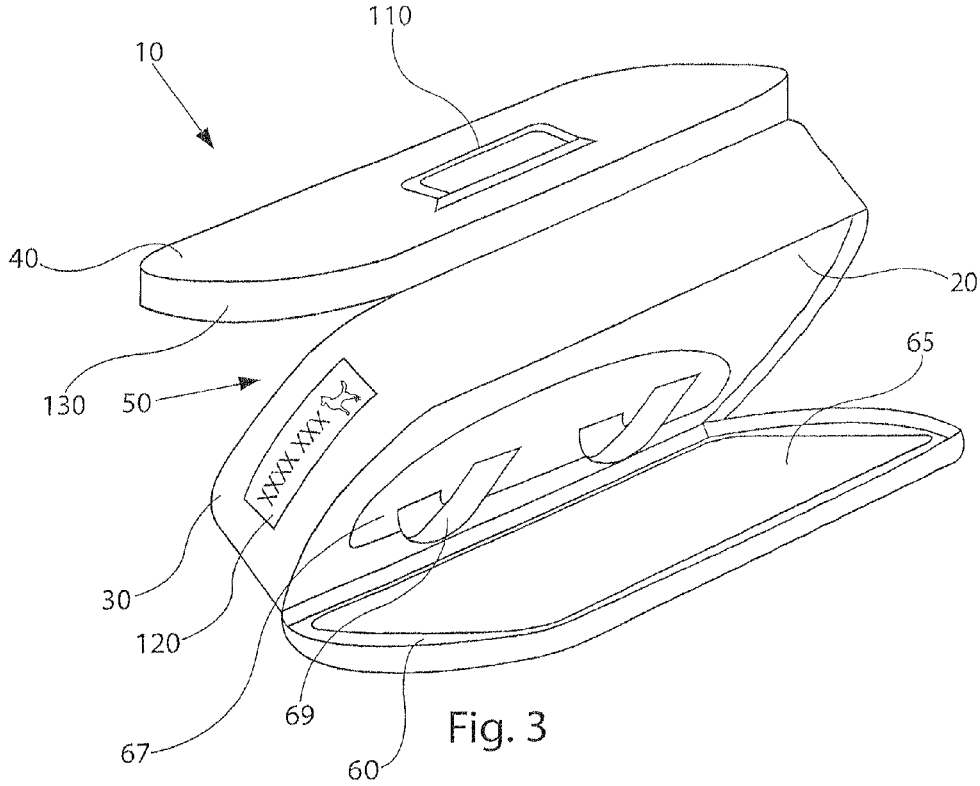
FIG. 3 is a plan view illustration of a compact animal waste collector showing a storage compartment, in accordance with the first exemplary embodiment of the present disclosure.
Figure 4:
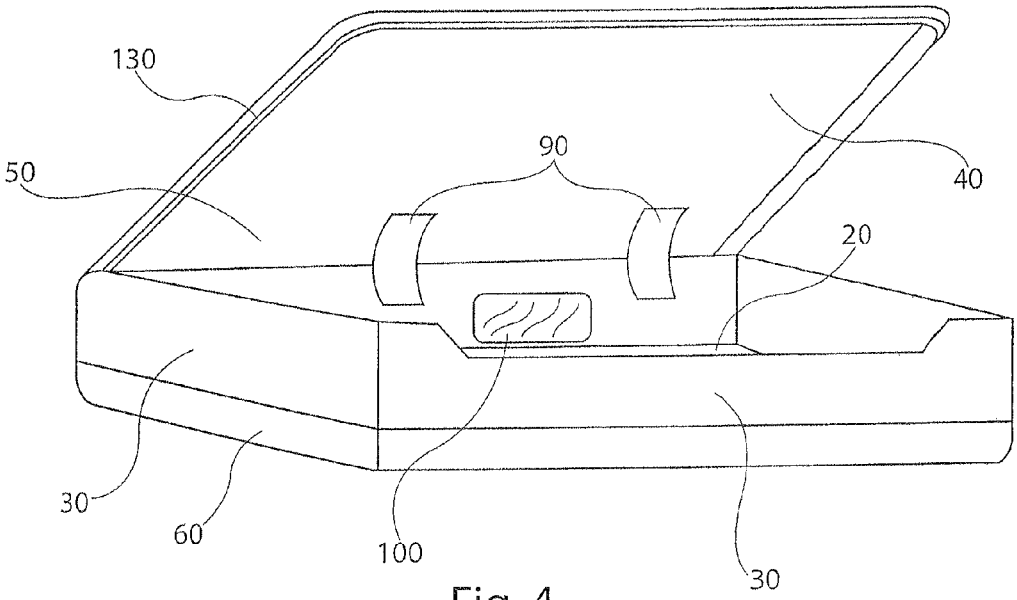
FIG. 4 is a plan view illustration of a compact animal waste collector showing an interior compartment without a bag, in accordance with the first exemplary embodiment of the present disclosure.

The structure of the collector 10 includes a base 20, which may be seen in more detail in FIGS. 3 and 4. The base 20 may be constructed from any material and has a substantially planar surface with at least a first side and a second side. The first side and second side may be opposite sides of the planar base 20. The base 20 is substantially rigid and durable enough to support the other components of the collector 10. The base 20 may include a fully planar surface, a substantially planar surface with a slight arc or curvature, or any combination thereof. The collector 10 may have any number of walls 30, including four walls configured in a rectangular fashion, as is illustrated in FIG. 1. The walls 30 may be affixed to the base 20 in any manner, and are positioned substantially perpendicular to the base 20. Depending on the material used, the walls 30 may be integral, affixed or removably connected with each other. As is illustrated in FIG. 1, the collector 10 may have a substantially cuboid shape, although the collector 10 may include any other type of shape.

The collector 10 may be constructed from a variety of materials, including disposable and non-disposable materials such as cardboard, corrugate, plastic compositions, metals, metallic compounds, synthetic materials, organic materials or any combination thereof. The construction of the collector 10 and the components thereof may largely depend on the type of material used. For example, if the collector 10 is constructed from cardboard or another disposal material, the base 20 and the plurality of walls 30 may be formed from a single piece of material that is folded and retained in a specified configuration. Alternatively, the collector 10 may be constructed from a plastic material, wherein the base 20 and the plurality of walls 30 are formed from one unitary molded plastic structure or a plurality of molded plastic structures fused together. Additionally, the base 20 and the plurality of walls 30 may be constructed from a metallic alloy that is welded together to form the collector 10. It is preferable for the collector 10 to be constructed from a material that has a high enough durability for repeated use.

A substantially planar first cover 40 is hinged to at least one of the plurality of walls 30. The interior compartment 50 that is formed from the first cover 40 is proximate to the first side of the base 20 and movable between at least a first position and a second position. In other words, the first cover 40 is movable between a closed position and an open position, which allows a quantity of animal waste 80 to be moved within the interior compartment 50 and closed within the collector 10. The collector 10 may be in the first position when the base 20, the plurality of walls 30, and the first cover 40 substantially enclose the interior compartment 50. In FIG. 1, the collector 10 is illustrated in the second position, wherein the first cover 40 is in an open position allowing access to the interior compartment 50.

The first cover 40 is hinged or attached by a hinged element to at least one of the plurality of walls 30. Similar to the base 20, the first cover 40 may have a fully planar shape, a substantially planar shape with a curved or arched surface, or any combination thereof. The first cover 40 may be hinged to the wall 30 by a variety of mechanisms, including a hinged element that is attached to or integral with the first cover 40. For example, a collector 10 that is constructed from molded plastic may include a first cover 40 that is integral with the base 20, wherein the hinged element is formed from a weakened portion in the plastic. The hinged element may also be formed from a pin hinge, an interconnected male/female system, or any other manner of forming a hinge.

A bag 70 is removably located at least partially within the collector 10 and lines the interior compartment 50 of the collector 10. The bag 70 has an opening edge 75, which is inverted about an exterior of the collector 10. When the bag 70 is inverted about the exterior surface of the collector 10, the inside surface of the bag 70 is exposed, which allows a quantity of animal waste to be inserted into the interior compartment 50. In addition, the inverted part of the bag 70 allows the bag 70 to act as a barrier between the collector 10 and the quantity of animal waste 80, which prevents the quantity of waste 80 from contacting the collector 10 when it is being inserted into the interior compartment 50. The collector 10 is sized to fully house virtually any quantity of animal waste 80 within the interior compartment 50. Due to the unpleasant smell, sight and texture of the quantity of waste 80, the collector 10 may store and fully house the quantity of waste 80 within the bag 70 and the interior compartment 50. This may prevent a texture, an odor and/or a sighting or viewability of the quantity of animal waste 80 from being sensed by the user, by feeling, smelling or seeing the quantity of waste 80. The bag 70 may also be constructed from an opaque and/or dark-colored material, thereby preventing any sight of the quantity of animal waste 80 stored within the bag 70.

On the second side of the base 20, the storage compartment 60 is formed integral with the collector 10. The storage compartment 60 is a compartment that is included within the structure of the collector 10 and may store an additional bag, or an additional tool used with the collector 10, such as a paddle shown in phantom at 200, which may be retained by a retaining member 202 also shown in phantom, to push the quantity of waste 80 into the interior compartment 50. As is illustrated in more detail in FIG. 3, the storage compartment 60 is formed opposing the first cover 40 and the interior compartment 50, thereby allowing the collector 10 to have functioning elements on more than one side. The storage compartment 60 is formed from the second side of the base 20, the plurality of walls 30 and is enclosable by a substantially planar second cover 65 hinged to at least one of the plurality of walls 30. The storage compartment 60 is sized to house at least one replacement bag. The second cover 65 may be moved between an open and closed position, thereby allowing access to the storage compartment 60, similar to the movement of the first cover 40 allowing access to the interior compartment 50.

In operation, the collector 10 that is ready to be used may be carried in the first position, where the first cover 40 is closed. When a quantity of animal waste 80 in need of clean up, the user of the collector 10 positions the first cover 40 into the second position to expose the interior compartment 50 with the bag 70. The user then places the collector 10 proximate to the quantity of waste 80 and relocates the quantity of waste 80 to the interior compartment 50. This may be done by simply closing the first cover 40 around the quantity of waste 80, with the collector 10 positioned in either a horizontal or vertical fashion. In addition, a user of the collector 10 may use a rigid paddle or another structure to push the quantity of waste 80 into the interior compartment. In either scenario, the collector 10 may be protected from the unsanitary quantity of waste 80 with the bag 70. This allows the user to successfully remove any quantity of waste 80 without worrying about dirtying the collector 10. Once the quantity of waste 80 is fully within the interior compartment, the user may move the first cover 40 from the second position to the first position, thereby enclosing the interior compartment 50. This may be done with the bag 70 still in the inverted position about the collector 10, with the bag 70 removed from the inverted position or with the bag 70 having quantity of waste 80 fully removed from the collector 10.

FIG. 2 is a plan view illustration of a compact animal waste collector 10 in a closed position, in accordance with the first exemplary embodiment of the present disclosure. The collector 10 in the closed position corresponds to the first cover 40 in the first position, wherein the interior compartment 50 is enclosed. As can be seen, when the first cover 40 is moved to the first position, the bag 70 may still be left within the collector 10. As the first cover 40 is moved proximate to the plurality of walls 30, the opening edge 75 of the bag 70 may be sealed between the first cover 40 and the plurality of walls 30, thereby creating a sealed edge 76. As can be seen in FIG. 2, a portion of the opening edge 75 of the bag 70 may be outside of the collector 10, since it is external to the sealed edge 76. In this arrangement, a quantity of animal waste 80 may be placed within the interior compartment 50 and securely enclosed within the bag 70 lining the interior compartment 50. The bag 70 may then be sufficiently sealed with a sealed edge 76 created by the first cover 40 being in the first position. In this configuration, the quantity of animal waste 80 will be separated from the outside atmosphere, which prevents the sight, texture and odor of the quantity of animal waste 80 from being sensed.

There are additional ways of enclosing a quantity of animal waste 80 within the collector 80 and thereby preventing a sight, a texture and an odor of the quantity of animal waste 80 from being sensed. One of these ways is by using a bag 70 that has a sealable edge, such as a bag 70 with a zipping fastener, as is commonly found within the food service industry. Similar sealing devices may be used with the bag 70 as well, including sealing ties 204, sealing adhesives or any other sealing device to enclose the quantity of animal waste 80 within the bag 70. A user of the collector 10 may seal the bag 70 appropriately, and then move the first cover 40 into the first position. Again, this prevents the sight, texture and odor of the quantity of animal waste 80 from being sensed and allows the user to carry around the collector 10 with the quantity of waste 80 until proper disposal is available. A user may also remove the bag 70 from the collector 10 once a quantity of waste 80 is placed within it. The user would remove the bag 70 from the inverted position and either seal the bag 70 or dispose of the bag 70. Thus, as one having ordinary skill in the art would recognize, the collector 10 may be used to not only collect the quantity of waste 80, but may also be used to seal the quantity of waste 80 within a bag 70 and/or retain the quantity of waste 80 within the structure of the collector 10 until disposal is available.

FIG. 3 is a plan view illustration of a compact animal waste collector 10 showing the storage compartment 60, in accordance with the first exemplary embodiment of the present disclosure. The collector 10 may include a variety of designs with the storage compartment 60 on the second side of the base 20 and the interior compartment 50 on the first side of the base 20. In FIG. 3, the storage compartment 60 and the interior compartment 50 are positioned on opposite sides of the base 20, wherein the first and second covers 40, 65, respectively, are hinged on opposing edges of the collector 10. Many variations of design may be used, all of which are included within the scope of the present disclosure.

As can be seen in detail, the storage compartment 60 includes the second cover 65, which is attached to one of the plurality of walls 30. The second cover 65 may be attached with a hinged element or by any other element capable of attaching the second cover 65 to one of the plurality of walls 30. Within the storage compartment 60 may be one or more replacement bags 67 which are retained with a retaining element 69. The retaining element 69 may include any design that is capable of retaining any number of replacement bags 67 in a substantially stationary position, with respect to the collector 10 as a whole. This may prevent a plurality of replacement bags 67 from falling from within the storage compartment 60 when the second cover 65 is opened. The retaining elements 69 may also retain other devices, such as a paddle used to push the quantity of animal waste 80 into the interior compartment or an antibacterial hand wipe, just to name a few.

The collector 10 may also include a belt clip 110 to hold the collector 10 on the belt or pocket of a user. The belt clip 110 may be located on any portion of the collector 10, such as the first cover 40 as illustrated in FIG. 3. An informational text or graphic element 120 may also be included with the collector 10 to provide the user of the collector 10 with information concerning the collector 10. The informational text or graphic element 120 may include text, a graphic, a picture, a raised informational element, or any combination thereof. For example, the informational text or graphic element 120 may be the name and logo of the company who produces the collector 10, the name of a park or recreation area, a map of a park or recreation area or the name of the owner of the collector 10. The informational text or graphic element 120 may be located on any surface, interior or exterior, of the collector 10.

Also illustrated in FIG. 3 is at least one lip 130 integral with the first cover 40. The at least one lip 130 may be located at an edge of the first cover 40 and may contact at least a portion of the walls 30 when the first cover 40 is in the first position. A lip 130 may also be included on the second cover 65, depending on the design and use of the collector 10. The lip 130 may form a sealing edge when the first cover 40 is in the first position. This sealing edge may form a sealed portion within a bag 70 being used with the collector 10, wherein the sealed portion separates an enclosed section of the bag 70 within the collector 10 from a non-enclosed portion of the bag 70 external to the collector 10.

FIG. 4 is a plan view illustration of a compact animal waste collector 10 showing the interior compartment 50 without a bag 70, in accordance with the first exemplary embodiment of the present disclosure. When the first cover 40 is in the second position, it can be seen that the interior compartment 50 may include a variety of additional components to provide more efficient use when collecting the quantity of animal waste 80. At least one biasing element 90 may be affixed to at least one of the base 20, the plurality of walls 30, and the first cover 40. The biasing element 90 is positioned to bias the first cover 40 into the second position when the interior compartment 50 is opened. The biasing element 90 may include a variety of devices, such as a spring, a biased flexible structure or a biased design within one or more components of the collector 10. In FIG. 4, the biasing element 90 is illustrated as a flexed structure that is affixed to one of the plurality of walls 30 and rises to abut the first cover 40.

In operation, the biasing element 90 contacts the first cover 40 and forces it away from the first position when the interior compartment 50 is enclosed. The biasing element 90 may retain the first cover 40 in the second position when no countering force is placed on the first cover 40. When a user grasps the collector 10, the user may force the first cover 40 towards the plurality of walls 30, thereby flexing the biasing element 90. The amount of force needed to bias the first cover 40 and the biasing element 90 may vary depending on design. Preferably, the biasing element 90 will have sufficient force to retain the first cover 40 in the second position, but will be easily biased with a minimal user force. When a bag 70 is placed within the collector 10 and inverted about the exterior of the collector 10, the biasing element 90 may help retain the bag 70 in an open position, thereby making it easier to insert a quantity of animal waste 80 into the interior compartment 50.

FIG. 4 further illustrates one or more bag retaining devices 100 located within the collector 10 and retaining the bag 70 in a substantially stationary position. The bag retaining device 100 may include an adhesive or sticky material, a pinching device, a clasp or any other device or mechanism that is capable of retaining the bag 70 in a substantially stationary position. The bag retaining device 100 may be located on the sidewall 30, as is shown in FIG. 4, or another part of the collector 10, such as the base or the first cover 40. The bag retaining device 100 may retain the bag 70 at least partially within the collector 10 and in a position lining the interior compartment 50. The bag retaining device 100 may allow easy removal and replacement of a bag 70 so the collector can be used a plurality of times.

Figure 5:
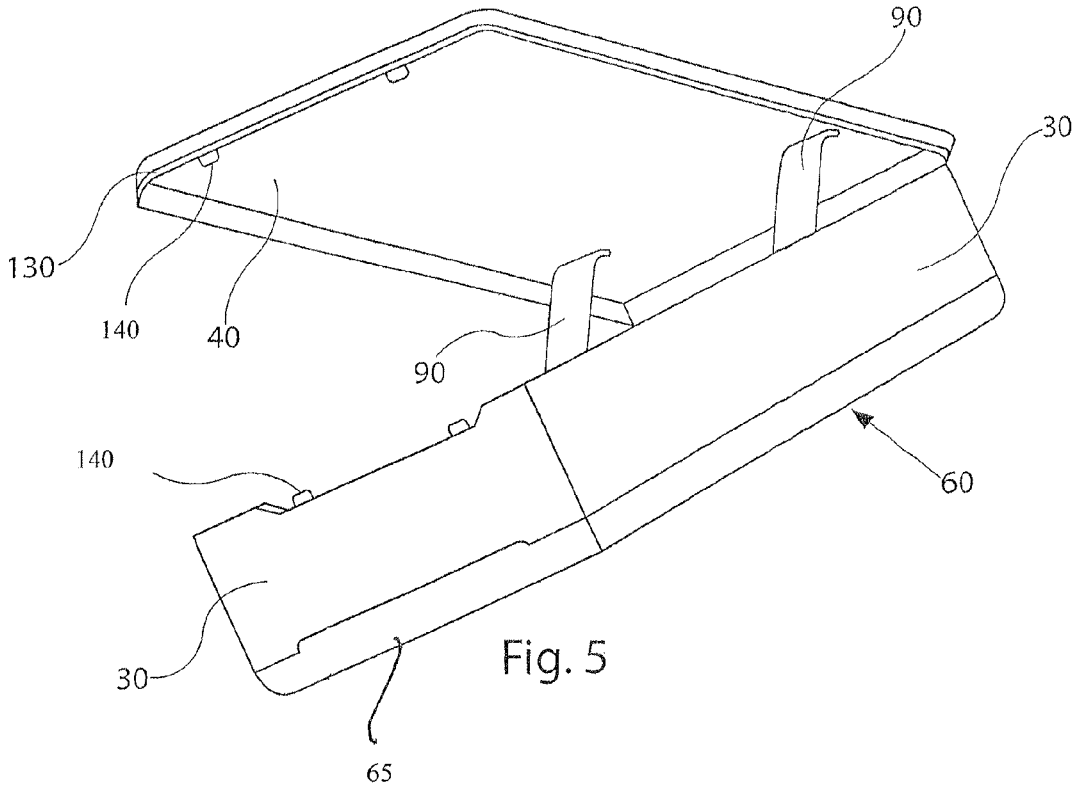
FIG. 5 is a plan view illustration of a compact animal waste collector showing a removable locking mechanism, in accordance with the first exemplary embodiment of the present disclosure.

FIG. 5 is a plan view illustration of a compact animal waste collector 10 showing a removable locking mechanism 140, in accordance with the first exemplary embodiment of the present disclosure. The removable locking mechanism 140 may be formed from any number of components, such as one or more components on each of the first cover 40 and the plurality of walls 30. The removable locking mechanism 140 may be affixed to at least one of the base 20 and the first cover 40 and may retain the first cover 40 in the first position. As can be seen, the removable locking mechanism 140 may include a variety of locking devices, such as a male/female fastener, a hook and loop fastener, a pin and slot fastener, or any combination thereof. The removable locking fastener 140 may retain the first cover 40 to the wall 30 for any period of time, and may be released and refastened as needed.

In use, a user may lock the first cover 40 to the wall 30 with the removable locking mechanism 140 when the collector 10 has a quantity of animal waste 80 inside the interior compartment 50. This will keep the first cover 40 from moving and subsequently releasing the quantity of waste 80. The removable locking mechanism 140 may also help retain the sealed portion 76 that is created within the bag 70 when the first cover is in the first position. As one having skill in the art can see, the locking mechanism 140 may be located on a variety of locations within the collector 10, all of which are considered within the scope of the present disclosure. A removable locking mechanism 140 may also be used with the second cover 65 to retain the second cover 65 in the closed position, thereby enclosing the storage compartment 60.

Figure 6:
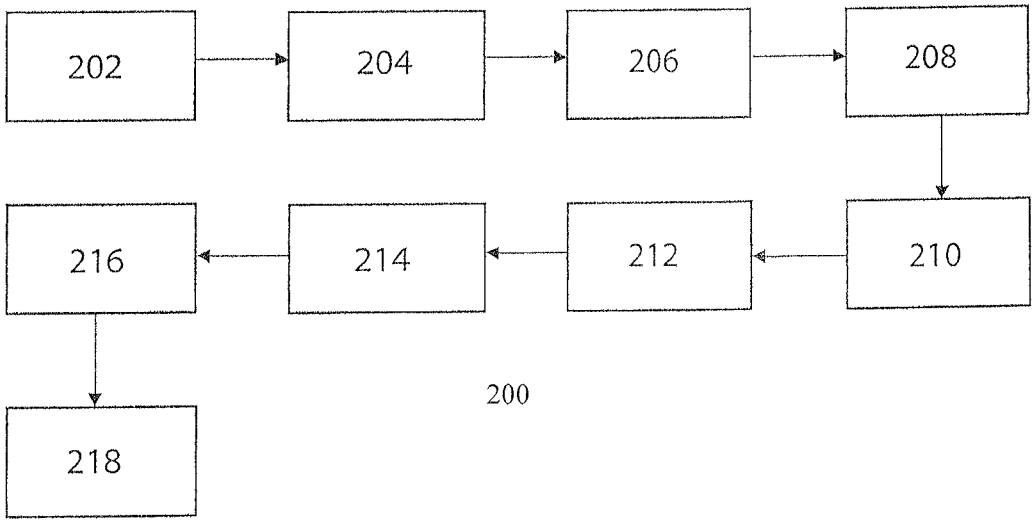
FIG. 6 is a flowchart illustrating a method of collecting and storing animal waste in accordance with the first exemplary embodiment of the disclosure.

FIG. 6 is a flowchart 200 illustrating a method of collecting and storing animal waste in accordance with the first exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, an interior compartment is formed within a collector, the interior compartment has a substantially planar base having a first side and a second side, a plurality of walls is affixed to the base and positioned substantially perpendicular to the base, and a substantially planar first cover is hinged to at least one of the plurality of walls, the first cover forms an interior compartment proximate to the first side of the base and is movable between at least a first position and a second position, wherein the first cover in the first position substantially encloses the interior compartment and the first cover in the second position forms at least one opening in the interior compartment. A storage compartment is formed on the second side of the base, wherein the storage compartment is enclosable by the plurality of walls and a substantially planar second cover is hinged to at least one of the plurality of walls (Block 204). At least one replacement bag is housed within the storage compartment (Block 206). The first cover is positioned in the second position (Block 208). An interior surface of the interior compartment is lined with a bag removably located at least partially within the collector (Block 210). An opening edge of the bag is inverted about an exterior of the collector, thereby exposing an inside surface of the bag (Block 212). The collector is positioned with the exposed inside surface of the bag proximate to a quantity of animal waste (Block 214). The quantity of animal waste is relocated to within the interior compartment, wherein the bag prevents the quantity of animal waste from contacting the collector (Block 216). The first cover is moved from the second position to the first position, thereby enclosing the quantity of animal waste within the interior compartment (Block 218).

Any additional number of steps may be included with the method of collecting and storing animal waste, including any portion of this disclosure. For example, the first cover may be continuously biased to the second position with at least one biasing device. When the either of the first and second covers is in the closed position, respectively, they may be retained with at least one removably locking mechanism. The bag may be removably retained at least partially within the collector with a bag retaining device housed within the interior compartment and affixed to at least one of the first side of the base, one of the plurality of walls and the first cover. The bag within the collector may be substantially sealed by moving the first cover from the second position to the first position. This may prevent at least one of a texture, an odor and a sighting of the quantity of animal waste from being sensed.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A compact animal waste collector comprising:

a substantially planar base having a first side and a second side;

a plurality of walls, affixed to the base and positioned substantially perpendicular to the base;

a substantially planar first cover hinged to at least one of the plurality of walls, the first cover forming an interior compartment proximate to the first side of the base and movable between at least a first position and a second position, wherein the first cover in the first position substantially encloses the interior compartment and the first cover in the second position forms at least one opening in the interior compartment;

a spring biasing element affixed to at least one of the base, at least one of the plurality of walls and the first cover, the spring biasing element biasing the first cover toward the second position;

a bag removably located at least partially within the collector and lining the interior compartment, the bag having an open edge inverted about at least a portion of an exterior of the collector thereby exposing an inside surface of the bag, wherein the collector is sized to fully house a quantity of animal waste within the interior compartment;

a storage compartment formed on the second side of the base and enclosable by the plurality of walls and a substantially planar second cover hinged to at least one of the plurality of walls, wherein the storage compartment is sized to house at least one replacement bag, wherein the compact animal waste collector is hand sized to be easily grasped by a person, and carried in a person's purse or pocket; and a device for sealing the open edge of the bag.

2. The compact animal waste collector of claim 1, further comprising at least one removable locking mechanism affixed to at least one of the base and the first cover, the at least one locking mechanism positioned to retain the first cover in the first position.

3. The compact animal waste collector of claim 1, further comprising at least one removable locking mechanism affixed to at least one of the base and the second cover, the at least one locking mechanism positioned to retain the second cover in a closed position, thereby enclosing the storage compartment.

4. The compact animal waste collector of claim 1, further comprising at least one lip integral with the first cover, wherein the at least one lip contacts at least one of the plurality of walls when the first cover is in the first position.

5. The compact animal waste collector of claim 4, wherein the at least one lip forms a sealing edge when the first cover is in the first position, the sealing edge forming a sealed portion within the bag separating an enclosed section of the bag from a non-enclosed section of the bag.

6. The compact animal waste collector of claim 1, further comprising a plurality of replacement bags housed within the storage compartment.

7. The compact animal waste collector of claim 6, further comprising a retaining element within the storage compartment, the retaining element retaining at least one of the replacement bags in a substantially stationary position within the storage compartment.

8. The compact animal waste collector of claim 1, further comprising at least one substantially rigid animal waste paddle housed within the storage compartment.

9. The compact animal waste collector of claim 8, further comprising a retaining element within the storage compartment, the retaining element retaining at least one of the at least one of the animal waste paddles in a substantially stationary position within the storage compartment.

10. The compact animal waste collector of claim 1, further comprising a belt clip affixed to an exterior surface of the compact animal waste collector.

11. The compact animal waste collector of claim 1, wherein at least one of a texture, an odor and a sighting of the quantity of animal waste is prevented from being sensed.

12. The compact animal waste collector of claim 1, further comprising a bag retaining device housed within the interior compartment and affixed to at least one of the first side of the base, one of the plurality of walls and the first cover, the bag retaining device removably retaining the bag at least partially within the collector and lining the interior compartment.

13. The compact animal waste collector of claim 12, wherein the bag retaining device further comprises at least one adhesive element.

14. The compact animal waste collector of claim 1, wherein the collector is imprinted with at least one of an informational text and an informational graphic.

15. The compact animal waste collector of claim 1, wherein the bag further comprises at least one of an opaque and dark-colored material, wherein the quantity of animal waste stored within the bag is unable to be viewed when the bag is closed.

16. A method of collecting and storing animal waste comprising:

providing a compact animal waste collector as claimed in claim 1, lining an interior surface of the interior compartment with a bag removably located at least partially within the collector;

inverting an opening edge of the bag about an exterior of the collector, thereby exposing an inside surface of the bag;

positioning the collector with the exposed inside surface of the bag proximate to a quantity of animal waste;

relocating the quantity of animal waste to within the interior compartment, wherein the bag prevents the quantity of animal waste from contacting the collector; and moving the first cover from the second position to the first position, thereby enclosing the quantity of animal waste within the interior compartment.

17. The method of collecting and storing animal waste of claim 16, further comprising the step of retaining at least one of the first cover and the second cover in a closed position with at least one removably locking mechanism.

18. The method of collecting and storing animal waste of claim 16, further comprising the step of removably retaining the bag at least partially within the collector with a bag retaining device housed within the interior compartment and affixed to at least one of the first side of the base, one of the plurality of walls and the first cover.

19. The method of collecting and storing animal waste of claim 16, further comprising the step of substantially sealing the bag by moving the first cover from the second position to the first position, wherein at least one of a texture, an odor and a sighting of the quantity of animal waste is prevented from being sensed.

* * * * *